US011046550B2

(12) United States Patent
Civolani et al.

(10) Patent No.: US 11,046,550 B2
(45) Date of Patent: Jun. 29, 2021

(54) ASSEMBLY FOR FOLDING POLYMERIC FILM FOR MACHINES FOR FORMING POUCHES AND THE LIKE

(71) Applicant: ILAPAK ITALIA S.P.A., Foiano Della Chiana (IT)

(72) Inventors: Daniele Civolani, Molinella (IT); Francesco Marchioni, Bologna (IT)

(73) Assignee: ILAPAK ITALIA S.P.A., Foiano Della Chiana (IT)

( * ) Notice: Subject to any disclaimer, the term of this patent is extended or adjusted under 35 U.S.C. 154(b) by 156 days.

(21) Appl. No.: 16/321,361

(22) PCT Filed: Jul. 18, 2017

(86) PCT No.: PCT/EP2017/068135

§ 371 (c)(1),
(2) Date: Jan. 28, 2019

(87) PCT Pub. No.: WO2018/019661

PCT Pub. Date: Feb. 1, 2018

(65) Prior Publication Data

US 2019/0168986 A1 Jun. 6, 2019

(30) Foreign Application Priority Data

Jul. 28, 2016 (IT) ..... 102016000079198

(51) Int. Cl.
*B65H 45/22* (2006.01)
*B31B 70/26* (2017.01)
(Continued)

(52) U.S. Cl.
CPC ..... *B65H 45/226* (2013.01); *B31B 70/00* (2017.08); *B31B 70/262* (2017.08); *B31B 70/36* (2017.08);
(Continued)

(58) Field of Classification Search
CPC ..... B31B 50/26; B31B 50/44; B31B 50/442; B31B 70/26; B31B 70/262; B31B 70/982;
(Continued)

(56) References Cited

U.S. PATENT DOCUMENTS 2,301,771 A * 11/1942 Billeb ..... B31B 70/00 493/302
2,324,393 A * 7/1943 Hohl ..... B31B 70/00 493/196

(Continued)

FOREIGN PATENT DOCUMENTS

DE 2503701 A1 8/1976
EP 2692649 A1 * 2/2014 ..... B65B 43/04
EP 2692649 A1 2/2014

OTHER PUBLICATIONS

International Search Report dated Sep. 29, 2017 re: Application No. PCT/EP2017/068135, pp. 1-3, citing: EP 2 692 649 A1, DE 25 03 701 A1 and US 4 666 423 A.

(Continued)

*Primary Examiner* — Nathaniel C Chukwurah
*Assistant Examiner* — Lucas E. A. Palmer
(74) *Attorney, Agent, or Firm* — Cantor Colburn LLP

(57) ABSTRACT

An assembly for folding polymeric film for machines for forming pouches and the like includes a fixed frame for supporting a magazine for the polymeric film, an element for folding the film that arrives from the magazine, and at least one heat-sealing device for the stable coupling of juxtaposed portions of the folded film that arrives from the folding element. The folding element is mounted on a carriage, which can translate along a respective guide which is integral with the frame, along the sliding direction of the film, with a speed that is variable in intensity and sign. The at least one heat-sealing device acts on portions folded onto themselves of the film during a temporary stop thereof. The (Continued)

carriage retracts with respect to the sliding direction of the film for the entire duration of the temporary stop step provided for the heat-sealing of the film.

10 Claims, 4 Drawing Sheets

(51) Int. Cl.
*B31B 70/64* (2017.01)
*B31B 70/36* (2017.01)
*B31B 70/00* (2017.01)
*B31B 155/00* (2017.01)

(52) U.S. Cl.
CPC ..... *B31B 70/645* (2017.08); *B65H 45/223* (2013.01); *B31B 2155/002* (2017.08); *B31B 2155/0014* (2017.08); *B65H 2301/4491* (2013.01); *B65H 2403/41* (2013.01); *B65H 2403/52* (2013.01); *B65H 2404/1321* (2013.01); *B65H 2511/20* (2013.01); *B65H 2513/10* (2013.01); *B65H 2519/00* (2013.01); *B65H 2701/191* (2013.01)

(58) Field of Classification Search
CPC ..... B31B 2120/408; B31B 2155/001; B31B 2170/204; B31B 70/00; B31B 70/645; B31B 70/36; B31B 2155/002; B31B 2155/0014; B65H 45/226; B65H 45/223; B65H 2301/4491; B65H 2403/41; B65H 2403/52; B65H 2404/1321; B65H 2511/20; B65H 2513/10; B65H 2519/00; B65H 2701/191
See application file for complete search history.

(56) References Cited

U.S. PATENT DOCUMENTS 2,326,931 A * 8/1943 Dalton ..... B29C 65/7891 493/190
2,329,353 A * 9/1943 La Bombard ..... B31B 70/00 493/460
3,059,549 A * 10/1962 Seiden ..... B31B 70/00 493/438
3,280,704 A * 10/1966 Ahlbrandt ..... B31B 70/00 493/435
3,431,828 A * 3/1969 Crawford ..... B65H 29/46 493/204
4,187,968 A * 2/1980 Winterholler ..... B41F 13/03 226/92
4,262,581 A * 4/1981 Ferrell ..... B29C 53/10 383/120
4,378,223 A * 3/1983 Branecky ..... B65H 45/22 493/439
4,580,473 A * 4/1986 Seiden ..... B65B 43/12 271/204
4,666,423 A 5/1987 Herrington
4,779,859 A * 10/1988 Knauer ..... B65H 45/221 270/41
5,016,863 A * 5/1991 Birkmair ..... B65H 45/221 270/41
5,181,365 A * 1/1993 Garvey ..... B65B 9/093 493/196
5,699,653 A * 12/1997 Hartman ..... B65H 45/221 53/455
5,832,825 A * 11/1998 Bladie ..... B65H 45/09 101/219
5,853,360 A * 12/1998 Jeffrey ..... B65D 5/443 493/178
5,902,222 A * 5/1999 Wessman ..... B65H 23/0216 493/439
5,993,368 A * 11/1999 Benovitz ..... B31B 70/00 493/196
6,004,252 A * 12/1999 Blaser ..... B31B 70/00 493/186
6,024,684 A * 2/2000 Maylander ..... B41F 13/58 270/41
6,195,967 B1 * 3/2001 Todd ..... B65B 1/02 53/562
6,635,002 B1 * 10/2003 Yeh ..... B26D 1/085 493/193
6,712,749 B1 * 3/2004 Michalik ..... B65H 45/221 270/41
7,393,316 B2 * 7/2008 Behmel ..... B65H 45/221 493/438
2001/0008064 A1 * 7/2001 Todd ..... B29C 66/8181 53/455
2001/0009090 A1 * 7/2001 Todd ..... B29C 66/8181 53/64
2004/0149799 A1 * 8/2004 Ruckmann ..... B41F 13/03 226/91
2006/0178251 A1 * 8/2006 Burger ..... B65H 45/09 493/439
2007/0060460 A1 * 3/2007 Theilacker ..... B65H 45/226 493/434
2009/0090260 A1 * 4/2009 Behmel ..... B41F 13/58 101/225
2009/0272481 A1 * 11/2009 Brauer ..... B65D 33/2591 156/66
2014/0274637 A1 * 9/2014 Ballestrazzi ..... B65B 9/06 493/243
2016/0082684 A1 * 3/2016 Jansen ..... A24F 23/02 493/189

OTHER PUBLICATIONS

IT Search Report dated May 19, 2017 re: Application No. IT 201600079198, pp. 1-7, citing: EP 2 692 649 A1, DE 25 03 701 A1 and US 4 666 423 A.
Written Opinion dated Sep. 29, 2017 re: Application No. PCT/EP2017/068135, pp. 1-5, citing: EP 2 692 649 A1, DE 25 03 701 A1 and US 4 666 423 A.

* cited by examiner

ASSEMBLY FOR FOLDING POLYMERIC FILM FOR MACHINES FOR FORMING POUCHES AND THE LIKE

TECHNICAL FIELD

The present disclosure relates to an assembly for folding polymeric film for machines for forming pouches and the like.

BACKGROUND

In machines designed to form pouches made of polymeric film, provisions are made for receiving a continuous ribbon of film (arriving from a corresponding spool) which, subjected to adapted folding and heat-sealing operations, allows to provide a series of mutually identical pouches.

In these machines there is an element that folds the flattened film that arrives from the spool and arranges and shapes it according to the shape according to which it can then be heat-sealed (along predefined lines) to then generate a pouch.

One of the critical aspects of the operation of said folding element, which is common to all machines of the known type, is the need to keep the sliding position of the film subjected to folding fixed after sliding on complementarily inclined edges of said folding element.

The particular folding that is required in the forming of pouches starting from a continuous ribbon of polymeric film forces the adoption of a folding element in which the complementarily inclined edges are arranged approximately like the two oblique sides of an isosceles triangle (and in which the vertex where they, or their extensions, meet substantially abuts against the centerline of the ribbon of polymeric film).

If displacements of the film occur, in particular in the case of displacements that are perpendicular to the advancement direction of the film that are caused by instantaneous and local friction variations, defects in the alignment of the flaps of the pouch (being produced) occur which lead to an aesthetic and/or functional problem for said pouch.

Downstream of the folding element, the film, folded appropriately, must be subjected to appropriate heat-sealing operations; these operations must be preferably performed with heat-sealing devices that are capable of generating very intense forces and therefore are sturdy and heavy. These requirements entail that heat-sealing devices that are ideal for applying a high pressure are not suitable to be provided with a film chasing movement.

One of the most efficient constructive solutions to ensure that heat-sealing is performed correctly is therefore that in that region the film is moved with a rule of the type known as "pilgrim process", with a stop that corresponds to the heat-sealing and a subsequent advancement stroke.

This rule of motion is also the one to which the film is normally subjected in passing over the folding element.

This rule of advancement at variable speed of the film on the fixed folding element creates cyclic variations in friction between the film and the edges of the element on which it slides, thus worsening the problems of transverse stability of the film, particularly at high production speeds.

Furthermore, it should be noted that between the folding element and these heat-sealing devices it is convenient to have a distance that is minimal (as small as possible) and a linear arrangement of the film in order to keep in position said film, which has just been folded but not yet fixed by a heat-sealing operation: between the folding element and the heat-sealing devices it is therefore necessary to avoid the interposition of buffers or other similar apparatuses for the temporary accumulation of film.

SUMMARY

The aim of the present disclosure is to solve the problems described above, by proposing an assembly for folding polymeric film for machines for forming pouches and the like in which the film is kept tensioned on the edges of the folding element with a constant force during all the forming steps.

Within this aim, the disclosure provides an assembly for folding polymeric film for machines for forming pouches and the like with fixed heat-sealing devices that have large dimensions and are suitable to apply intense pressures to the flaps of film being heat-sealed.

The present disclosure proposes an assembly for folding polymeric film for machines for forming pouches and the like that ensures that the ideal alignment of the flaps of the film being folded is maintained during all the steps of the pouch forming process.

The present disclosure also provides an assembly for folding polymeric film for machines for forming pouches and the like that has modest costs, is relatively simple to provide in practice, and is safe in application.

This aim and these and other advantages which will become better apparent hereinafter are achieved by providing an assembly for folding polymeric film for machines for forming pouches and the like, of the type comprising a fixed frame for supporting a magazine for said polymeric film, an element for folding the film that arrives from said magazine and at least one heat-sealing device for the stable coupling of juxtaposed portions of said folded film that arrives from said folding element, characterized in that said folding element is mounted on a carriage, which can translate along a respective guide which is integral with said frame, along the sliding direction of said film, with a speed that is variable in intensity and sign, said at least one heat-sealing device acting on portions folded onto themselves of said film during a temporary stop thereof, said carriage retracting with respect to said sliding direction of said film for the entire duration of the temporary stop step provided for the heat-sealing of the film.

BRIEF DESCRIPTION OF THE DRAWINGS

Further characteristics and advantages of the disclosure will become better apparent from the description of a preferred but not exclusive embodiment of the assembly for folding polymeric film for machines for forming pouches and the like according to the disclosure, illustrated by way of nonlimiting example in the accompanying drawings, wherein.

DETAILED DESCRIPTION OF THE DRAWINGS

Figure 1:
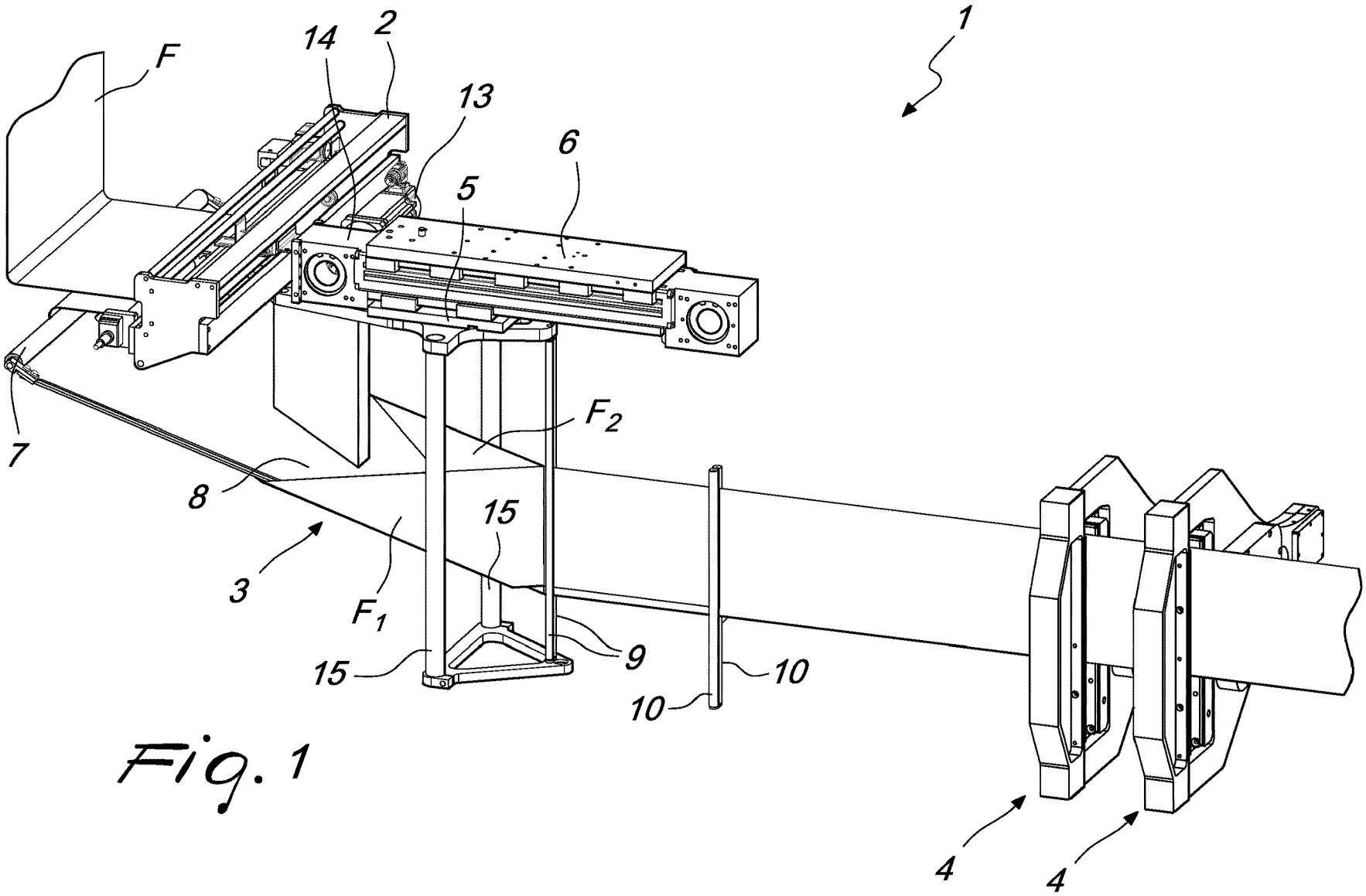
FIG. 1 is a schematic axonometric view of the assembly for folding polymeric film for machines for forming pouches and the like according to the disclosure.
Figure 2:
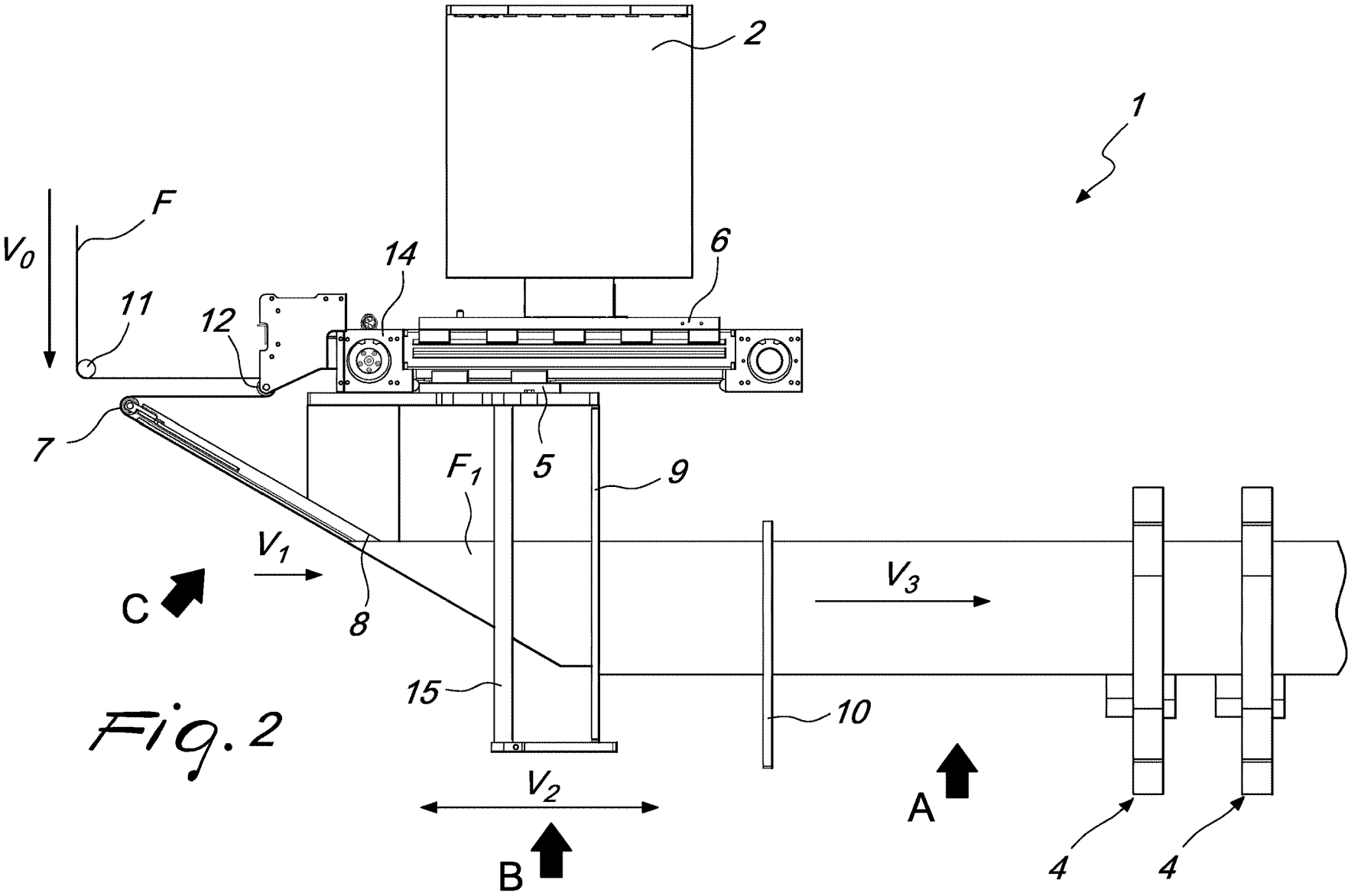
FIG. 2 is a schematic side view of the assembly of FIG. 1.

With particular reference to FIGS. 1-4, the reference numeral 1 generally designates an assembly for folding polymeric film F for machines for forming pouches and the like.

The folding assembly 1 comprises a fixed frame 2 for supporting a magazine for storing the polymeric film F: the magazine is suitable to accommodate at least one spool of film F.

The dimensions of the film F collected in the spool depend on the dimensions and the shape of the pouch to be provided. The material of which the film F is made is preferably a thermoplastic polymer in order to allow its easy heat-sealing. If other materials are used, it is necessary to provide for the presence of further additional layers designed to ensure the correct mating of flaps of film F during the shaping of the pouch.

An element 3 for folding the film F that arrives from the magazine and at least one heat-sealing device 4 for the stable coupling of juxtaposed portions of the folded film F that arrives from the folding element 3 are also associated with the frame 2.

The folding element 3 is mounted on a carriage 5 which can translate along a respective guide 6 which is integral with the frame 2: the carriage 5 can move along the guide 6 along the sliding direction of the film F, with a speed that can vary in intensity and sign.

The at least one heat-sealing device 4 acts on portions folded onto themselves of the film F during a temporary stop thereof.

The carriage 5 retracts with respect to the sliding/advancement direction of the film F for the entire duration of the temporary stop step provided for the heat-sealing of the film F.

In this manner, despite the stop step, the film F continues to slide along the surface of the folding element 3.

Interruption of the sliding of the film on the folding element 3 would in fact cause a great increase in the frictions that can be observed during the restarting of the film F (the temporary adhesion of the film F to the folding element 3 can be attributed to so-called first separation friction, which is always greater than the dynamic friction that occurs during the sliding of the film F on the element 3).

Keeping the friction below a predefined threshold, which is achieved by virtue of the condition of constant sliding of the film F on the folding element 3 (even during the stop steps required for the heat-sealing operations), ensures that the film F is not subjected to excessive tractions which might cause (elastic and/or plastic) deformations thereof, which would affect negatively the quality of the pouches being provided.

According to a particular constructive solution of unquestionable interest in practice and in application, the folding element 3 comprises at least one roller 7 for diverting the direction of the film F, at least one plate 8 for folding the film F which has a substantially triangular shape.

During the movement of the film F along the folding element 3, the flaps $F_1$ and $F_2$ of the film F slide along the edges of the plate 8, undergoing a rotation until they face each other and are mutually proximate.

In practice, the folding element 3 allows to fold longitudinally, generally along the centerline, the film F, forming with the connecting portion between the two flaps $F_1$ and $F_2$ one of the walls of the pouch being provided.

The folding element 3, in a particularly efficient version thereof, further comprises, downstream of the plate 8, at least one pair of mutually parallel and closely spaced juxtaposition rollers 9.

The film F, which is folded so that the mutually opposite flaps $F_1$ and $F_2$ face each other and are mutually proximate, therefore slides between the rollers 9, undergoing a transverse compression with consequent juxtaposition of the flaps $F_1$ and $F_2$ up to a substantially coplanar configuration.

In this manner, the folding of the film F is completed and the two flaps $F_1$ and $F_2$ are pressed against each other and rested on a common plane.

An optimum stability of the folded film F, which allows the execution of particularly precise heat-sealing operations, can be achieved by adopting at least two pairs of juxtaposition rollers 9, 10.

The first pair of rollers 9 is integral with the folding element 3, while the second pair 10 can be conveniently fixed with respect to the frame 2, upstream of the at least one heat-sealing device 4.

In order to ensure the correct alignment of the film F at the inlet of the folding element 3, appropriate substantially cylindrical guiding elements 11 and 12 are interposed between the magazine of the polymeric film F and the folding element 3.

With particular reference to the constructive solution shown (by way of nonlimiting example) in the accompanying figures, the film F arrives from the magazine along a first direction, undergoes a first redirection by means of the guiding element 11 (a redirection which in the graphic example corresponds substantially to an angle of 90°) and a second redirection by means of the guiding element 12 (a redirection which in the graphic example corresponds substantially to an angle of 180°) in order to reach the roller 7 arranged upstream of the folding element 3 with the correct alignment.

In order to clarify the manner of movement of the translatable carriage 5 with respect to the corresponding fixed guide 6, it is specified that an actuation system is interposed between the carriage 5 and the guide 6 and is controlled by a respective control and management unit to adjust the rule of motion of the carriage 5 as a function of the feed rate of the film F from the magazine, of the rule of motion of the folded film F at the at least one heat-sealing device 4, of the characteristics of the polymeric film F, and of the dimensions of the pouch to be provided.

The dimensions of the pouch will affect the stroke, and the speed with which the stroke will be covered, of the carriage 5, the characteristics of the film F (in particular the type of material of which it is made and its thickness) will affect the duration of the stop required in order to provide optimum heat-sealing of the flaps $F_1$ and $F_2$, while the speeds of the film F in the various portions of the machine obviously will constitute one of the fundamental parameters which the rule of motion of the carriage 5 will have to follow.

The previously cited actuation system can validly comprise (with reference by way of example to a possible embodiment) a controlled motor 13, a gear reduction unit 14 and a transmission device of the type of a worm screw and female thread pair, of a pinion and rack pair, of a pinion and toothed belt pair, of a belt and pulley pair, of a chain and sprocket pair, and the like.

In any case, the use of actuators of a different type, such as linear induction motors, fluid-operated actuators, and the like, is not excluded.

It is appropriate to specify that the heat-sealing devices 4 can also be at least two, of a type that is integral with the frame and suitable to apply an intense pressure to the folded film F that is arranged inside them during heat-sealing.

The heat-sealing devices 4 suitable to apply intense pressure to the juxtaposed flaps $F_1$ and $F_2$ allow to perform more precise and qualitatively improved heat seals.

If one considers that the pouches made of polymeric film F are used predominantly to contain liquids (although their use also extends to the packaging of any type of solid, liquid and/or potentially even gaseous product/substance), it is immediately evident that the quality of the heat seals must be optimum in order to ensure tightness.

Moreover, in some points multiple folded layers of film F are superimposed and additional elements, such as bands for the removable coupling of the flaps $F_1$ and $F_2$ and the like, may also be interposed, and can be managed correctly by the heat-sealing devices 3 only if the pressure that is applied is such as to deform them by making them thinner.

Furthermore, it is specified that apparatuses for adjusting the mutual position of the heat-sealing devices 4 are interposed between the frame 2 and the devices 4 in order to vary the distance between two consecutive heat-sealing lines, which correspond to the width of a pouch to be provided.

This adjustment allows to move mutually closer and/or further apart the heat-sealing devices 4; it in fact allows to vary one of the dimensions of the pouch being produced (width or length), thus ensuring high versatility of the machine that comprises the assembly 1 according to the disclosure.

Finally, it is specified that upstream of the at least one pair of mutually parallel and closely spaced juxtaposition rollers 9 and 10 there are respective containment bars 15, which are parallel and symmetrical with respect to the folding line of the film F, in order to keep the edges of the flaps $F_1$ and $F_2$ in a mutually facing and complementarily inclined configuration that is ideal for subsequent entry between the juxtaposition rollers 9.

The operation of the disclosure is as follows.

Since the rule of advancement at variable speed of the film F on the folding elements of a known type creates cyclic variations in friction between the film F and the corresponding contoured plate, this cyclic speed variation increases the transverse stability problems of the film, particularly at high production speeds. The cyclic speed variation in fact induces (as already described earlier) tensions (also with deforming effects) on the film F, compromising the quality of the pouches that will be subsequently provided with it.

The assembly 1 according to the disclosure instead comprises a folding element 3 which is provided with a movement in the direction of the sliding of the film F, with the same cycle as the rule of motion $V_3$ of the film F (required for the correct execution of the heat-sealing steps) but with a rule of motion $V_2$ that levels out the sliding speed $V_1$, which is the one responsible for friction variations.

By eliminating the steps with nil relative speed $V_1$ and by leveling out said speed toward a value, it is in fact possible to prevent static conditions of the film F on the plate 8 which would cause a great increase in friction thereof (during resumption of motion after a stop it would be necessary to also overcome first separation friction).

Depending on the type of operation that one intends to obtain, it is possible to vary the rule of motion by composing the rules of motion of the folding element 3 (area B, speed $V_2$), the rule of motion of the film that arrives from the magazine ($V_0$) and the rule of motion of the film F, in which there are stops in order to allow the heat-sealing devices 4 to perform their function (area A, speed $V_1$).

Figure 4:
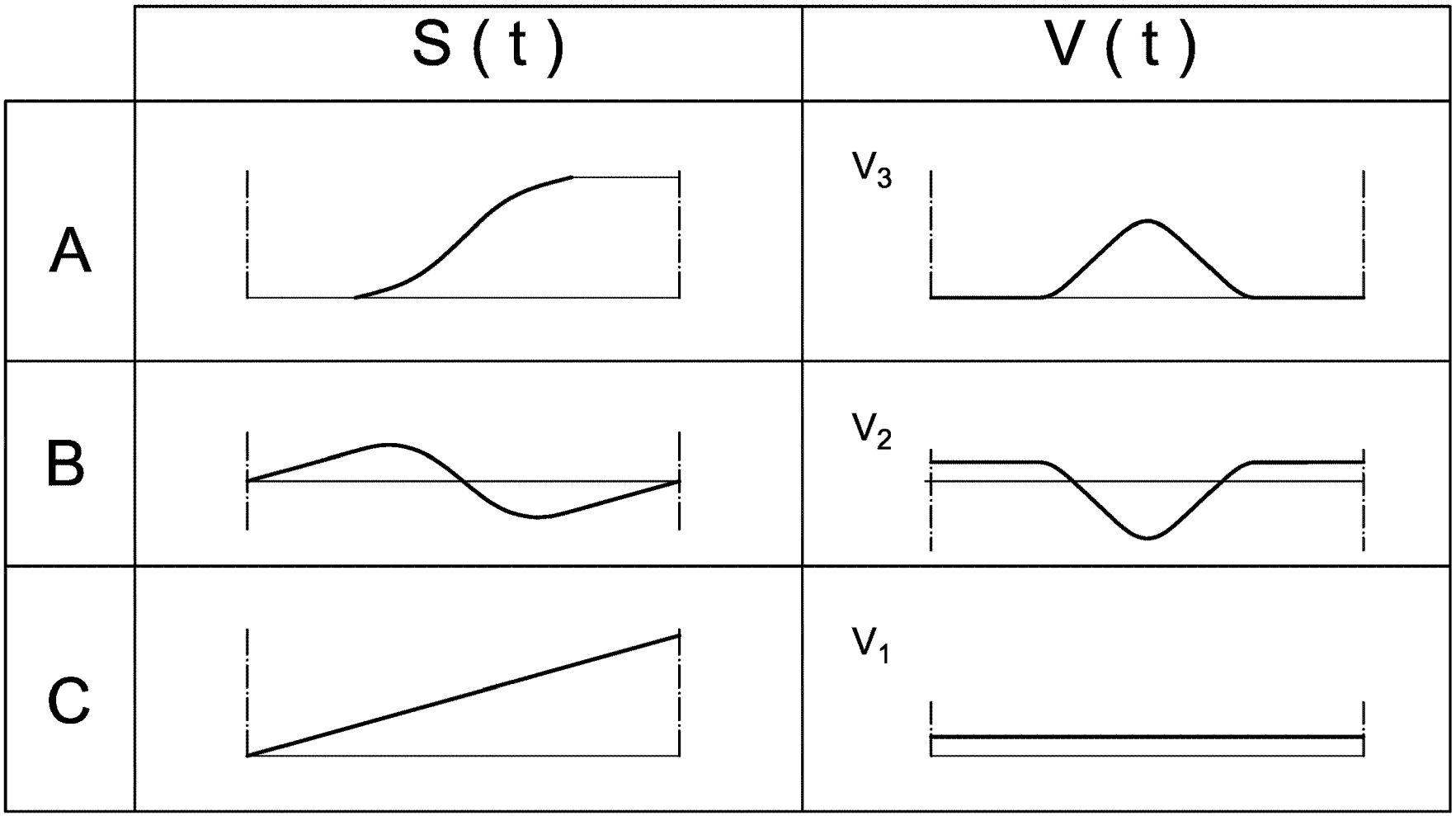
FIG. 4 is a schematic view of the behavior of a second rule of motion in an assembly according to the disclosure.

By varying these parameters it is possible to obtain a relative speed $V_1$ between the folding element 3 and the film F (in the area C) which is always constant, as shown in FIG. 4.

Figure 3:
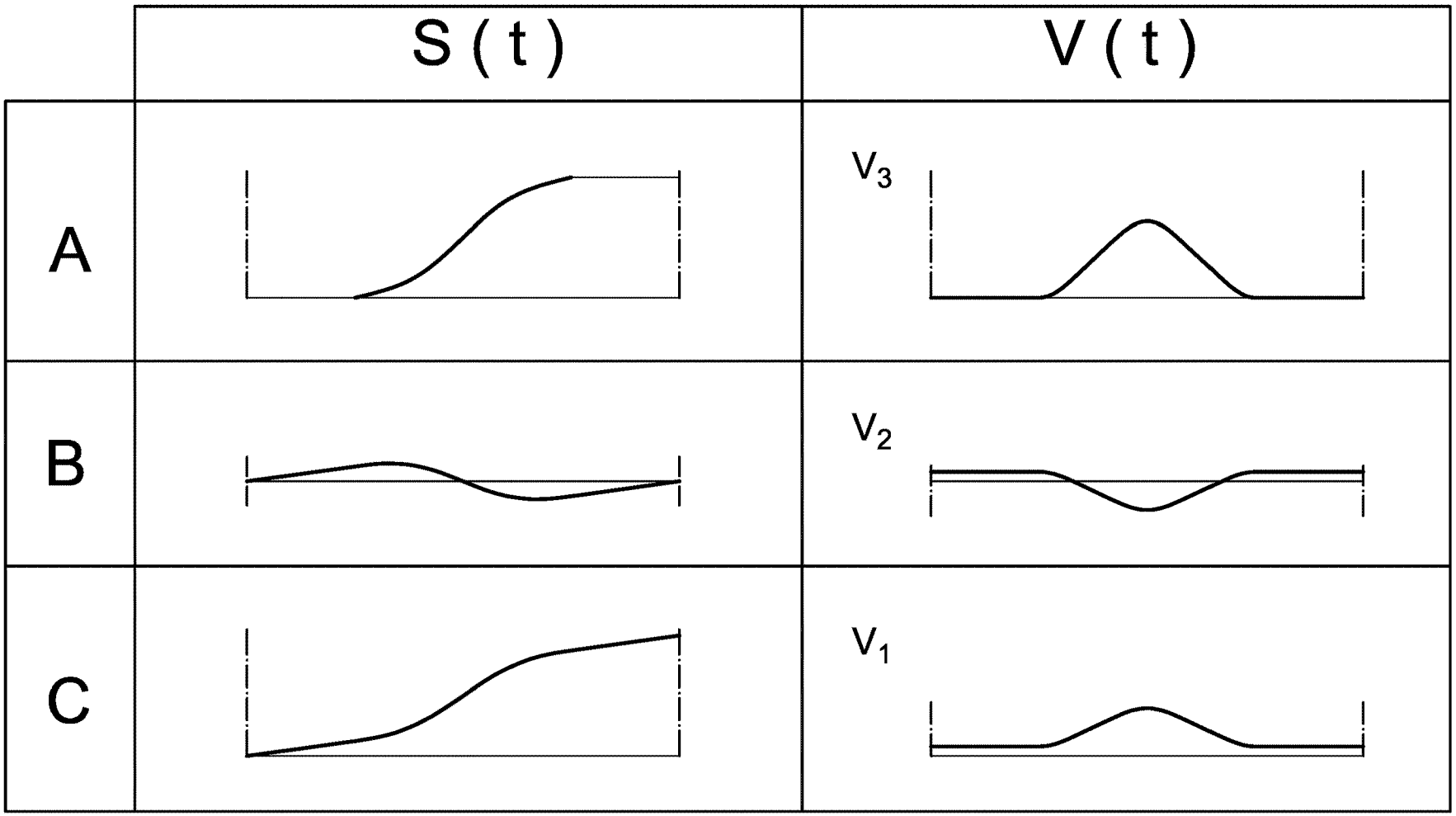
FIG. 3 is a schematic view of the behavior of a first rule of motion in an assembly according to the disclosure.

Likewise, it is also possible to obtain a speed of the film F upstream of the folding element, i.e., the rule of motion of the film that arrives from the magazine ($V_0$), which is always constant, as shown in FIG. 3.

The two modes of operation described above (and shown schematically with the charts of FIGS. 3 and 4), both obtainable for an equal rule of motion $V_0$ downstream of the folding element, which must always provide for stop intervals of the type of the operation known as pilgrim process.

Advantageously, it has therefore been shown that the present disclosure solves the problems described earlier, proposing an assembly 1 for folding polymeric film F for pouch forming machines and the like in which the film F is kept under tension on the edges of the folding element with a constant force during all the forming steps.

Validly, the folding assembly 1 according to the disclosure uses fixed heat-sealing devices 4, which are large and suitable to apply intense pressures to the flaps $F_1$ and $F_2$ of film F being heat-sealed.

Conveniently, the folding assembly 1 according to the disclosure ensures retention of the ideal alignment of the flaps $F_1$ and $F_2$ of the film F being folded during all the steps of the pouch forming process.

Positively, the folding assembly 1 according to the disclosure is relatively simple to provide in practice and substantially at modest cost: these characteristics render the assembly 1 according to the disclosure an innovation of assured application.

The disclosure thus conceived is susceptible of numerous modifications and variations, all of which are within the scope of the appended claims; all the details may further be replaced with other technically equivalent elements.

In the exemplary embodiments shown, individual characteristics, given in relation to specific examples, may actually be interchanged with other different characteristics that exist in other exemplary embodiments.

In practice, the materials used, as well as the dimensions, may be any according to the requirements and the state of the art.

The disclosures in Italian Patent Application No. 102016000079198 (UA2016A005572) from which this application claims priority are incorporated herein by reference.

The invention claimed is:

1. An assembly for folding polymeric film for machines for forming pouches, the assembly comprising: a fixed frame for supporting a magazine for said polymeric film, an element for folding the film that arrives from said magazine and at least one heat-sealing device for the stable coupling of juxtaposed portions of said folded film that arrives from said folding element, wherein said folding element is mounted on a carriage and comprises at least one plate configured to fold the film along a folding line to draw closer to each other two flaps of the film at the opposite side of the folding line before it arrives to the heat-sealing device, said carriage being configured to translate along a guide which is integral with said frame, along a sliding direction of said film, with a speed that is variable in intensity and sign in order to cause a back and forth motion of said plate with respect to the at least one heat-sealing device, said at least one heat-sealing device acting on portions folded onto themselves of said film during a temporary stop step thereof, said carriage retracting with respect to said sliding direction of said film for the entire duration of the temporary stop step provided for the heat-sealing of the film.

2. The folding assembly according to claim 1, wherein said folding element comprises at least one roller for diverting the direction of the film, said roller being placed upstream to said at least one plate, said at least one plate having a substantially triangular shape, flaps of the film, by sliding along edges of said plate, undergoing a rotation until the flaps face each other and are mutually proximate.

3. The folding assembly according to claim 2, further comprising downstream of said plate, at least one pair of parallel and mutually close juxtaposition rollers, said film, folded such that the flaps face each other and are proximate, by sliding between said rollers, undergoing a transverse compression with a consequent juxtaposition of said flaps until a substantially coplanar configuration is achieved.

4. The folding assembly according to claim 3, wherein the pairs of juxtaposition rollers are at least two, at least one first pair being integral with said folding element and at least one second pair being integral with said frame, upstream of said at least one heat-sealing device.

5. The folding assembly according to claim 3, wherein upstream of the at least one pair of mutually parallel and closely spaced juxtaposition rollers there are respective containment bars, which are parallel and symmetrical with respect to the folding line of said film, in order to keep the edges of the flaps of film in a mutually facing configuration which is complementarily inclined and is ideal for subsequent entry between the juxtaposition rollers.

6. The folding assembly according to claim 1, wherein between said magazine for said polymeric film and said element for folding the film appropriate guiding elements are interposed, which have a substantially cylindrical shape, for the alignment of said film with the inlet of said folding element.

7. The folding assembly according to claim 1, wherein an actuation system is interposed between said translatable carriage and the respective guide that is integral with said frame and is controlled by a respective control and management unit for the adjustment of the rule of motion of said carriage as a function of the supply speed of the film from the magazine, of the rule of motion of the folded film at the at least one heat-sealing device, of characteristics of the polymeric film and of dimensions of the pouch to be provided.

8. The folding assembly according to claim 7, wherein said actuation system comprises a controlled motor, a gear reduction unit, and a transmission device of the type of a worm screw and female thread pair, of a pinion and rack pair, of a pinion and toothed belt pair, of a belt and pulley pair, of a chain and sprocket pair.

9. The folding assembly according to claim 1, wherein said heat-sealing devices are at least two that are integral with said frame and adapted to apply a high pressure to the folded film arranged inside them during heat-sealing.

10. The folding assembly according to claim 9, wherein apparatuses for the adjustment of the mutual position of said heat-sealing devices are interposed between said frame and said heat-sealing devices in order to vary a distance between two consecutive heat-sealing lines that correspond to a width/length of a pouch to be provided.

* * * * *